United States Patent [19]

Porter et al.

[11] 4,284,305

[45] Aug. 18, 1981

[54] APPARATUS FOR UPHOLSTERING A VEHICLE CHAIR

[75] Inventors: Charles A. Porter; James M. Kozak, both of Colleyville, Tex.

[73] Assignee: Nautical Interiors Corporation, Fort Worth, Tex.

[21] Appl. No.: 8,440

[22] Filed: Feb. 1, 1979

[51] Int. Cl.[3] ..... A47C 27/00; A47C 7/02

[52] U.S. Cl. ..... 297/452; 24/259 R; 297/218; 297/219

[58] Field of Search ..... 5/403–407; 29/91.1; 297/218, 219, 226, 452, 454–456; 160/392, 394, 395, 397; 24/259 R

[56] References Cited

U.S. PATENT DOCUMENTS

| | | | |
|---|---|---|---|
| 2,881,766 | 4/1959 | Tornsjo | 24/259 R |
| 2,974,383 | 3/1961 | Bright | 24/259 FS |
| 3,003,215 | 10/1961 | Fernberg | 24/259 R |
| 3,349,454 | 10/1967 | Thomson | 24/259 R |
| 3,842,456 | 10/1974 | Bronstein | 297/218 |
| 3,958,285 | 5/1976 | Gorman | 297/218 |
| 3,995,892 | 12/1976 | Hellman et al. | 297/219 |

FOREIGN PATENT DOCUMENTS

| | | | |
|---|---|---|---|
| 2236345 | 1/1975 | France | 297/452 |

*Primary Examiner*—James T. McCall
*Attorney, Agent, or Firm*—James E. Bradley

[57] ABSTRACT

An apparatus and method for securing the front and back upholstery material portions together over a metal frame for a chair back in a vehicle chair. The chair back is of the type that folds downwardly. A channel member is secured to the bottom of the frame for the chair back. Clips having U-shaped portions are secured to the channel so that the U-shaped portions face out of the channel. The upholstery material is sewed into an enclosure with a front portion, a back portion, and an open bottom. The enclosure is inserted over the metal frame. The ends of the front and back portions are tightly drawn together and inserted into the clips for retention. Stiffening members are secured to the ends.

7 Claims, 4 Drawing Figures

Fig. 1
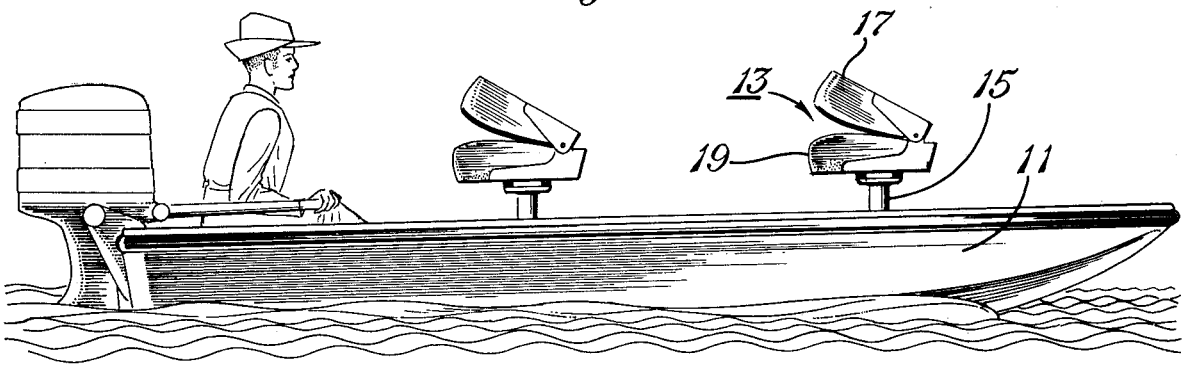
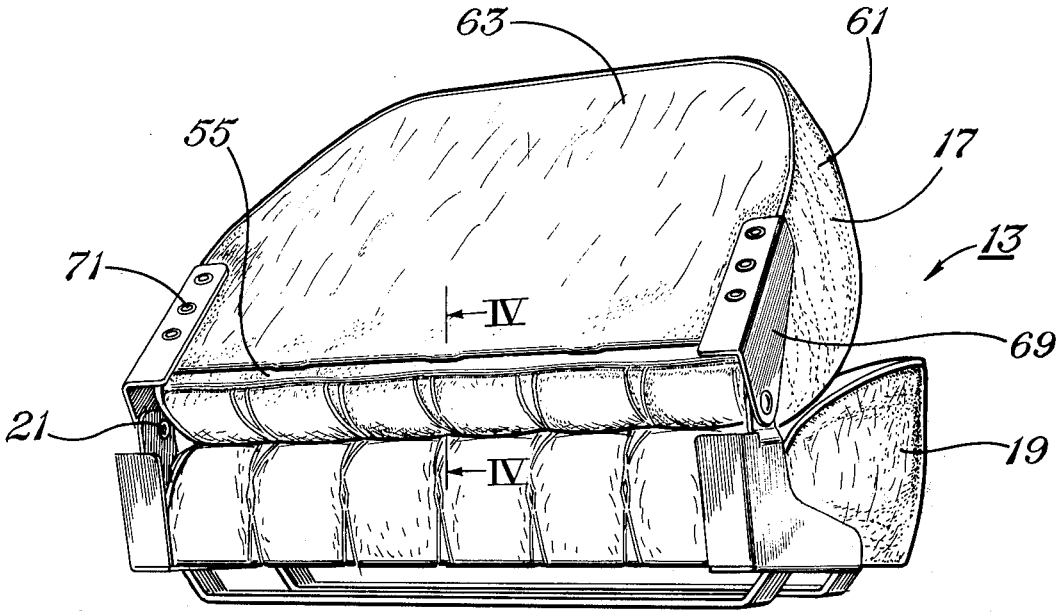
Fig. 2
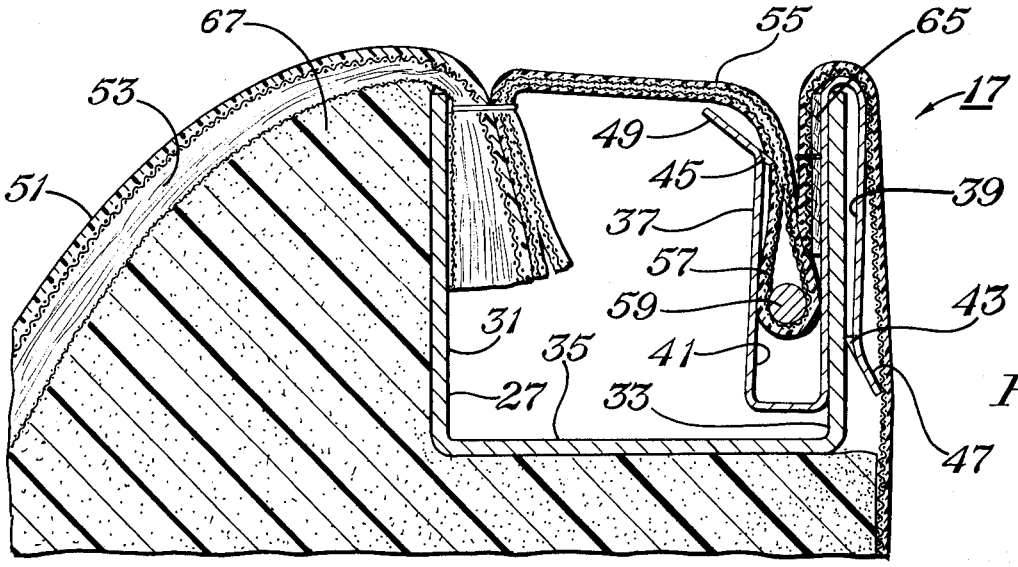
Fig. 4

APPARATUS FOR UPHOLSTERING A VEHICLE CHAIR

BACKGROUND OF THE INVENTION

1. Field of the Invention

This invention relates in general to upholstering, and in particular to an apparatus and method for upholstering a vehicle chair back.

2. Description of the Prior Art

Many pleasure boats, particularly the so-called "bass boats", have upholstered and padded swivel chairs positioned fairly high for casting. When driving the boat with the main engine, often the operator sits near the rear of the boat. To improve visibility, the backs of the swivel chairs are hinged to the seat so that they can be folded down. The backs are also usually folded down while towing the boat.

In upholstering the chair backs, the front, back and side portions are first sewn together into an open-bottomed enclosure. The enclosure is inserted over the frame of the back, and the front and back portions are secured by various means at the bottom. While the back is folded down, the base or bottom of it is exposed. Consequently it is desirable to have an attractive closure means for securing the front and back portions together. Also, a fast and simple method for securing the back portion to the front portion for vehicle chair backs in general is desirable.

SUMMARY OF THE INVENTION

It is accordingly the general object of this invention to provide an improved means and method for upholstering the back of a vehicle chair.

It is a further object of this invention to provide an improved means and method for securing the front upholstered portion to the back upholstered portion of the back of a vehicle chair.

In accordance with these objects, a metal frame for the back is used with a channel member secured across its bottom. The channel faces downward. A number of clips having two U-shaped portions facing in opposite directions are carried by the channel member. One U-shaped portion is tightly inserted over one of the channel member walls, while the other U-shaped portion is located in the channel and faces out of it. A stiffener rod is attached to the end of the front upholstered portion and a stiffener strip is sewn to the end of the back upholstered portion. These ends are drawn tightly together and wedged into the U-shaped portion of the clip.

BRIEF DESCRIPTION OF THE DRAWINGS

FIG. 1 is a perspective view of a boat having swivel chairs constructed in accordance with this invention.

FIG. 2 is a perspective view of one of the swivel chairs of FIG. 1.

FIG. 4 is a cross-sectional view of one of the chairs of FIG. 1, taken along the line IV—IV of FIG. 2.

DESCRIPTION OF THE PREFERRED EMBODIMENT

Figure 3:
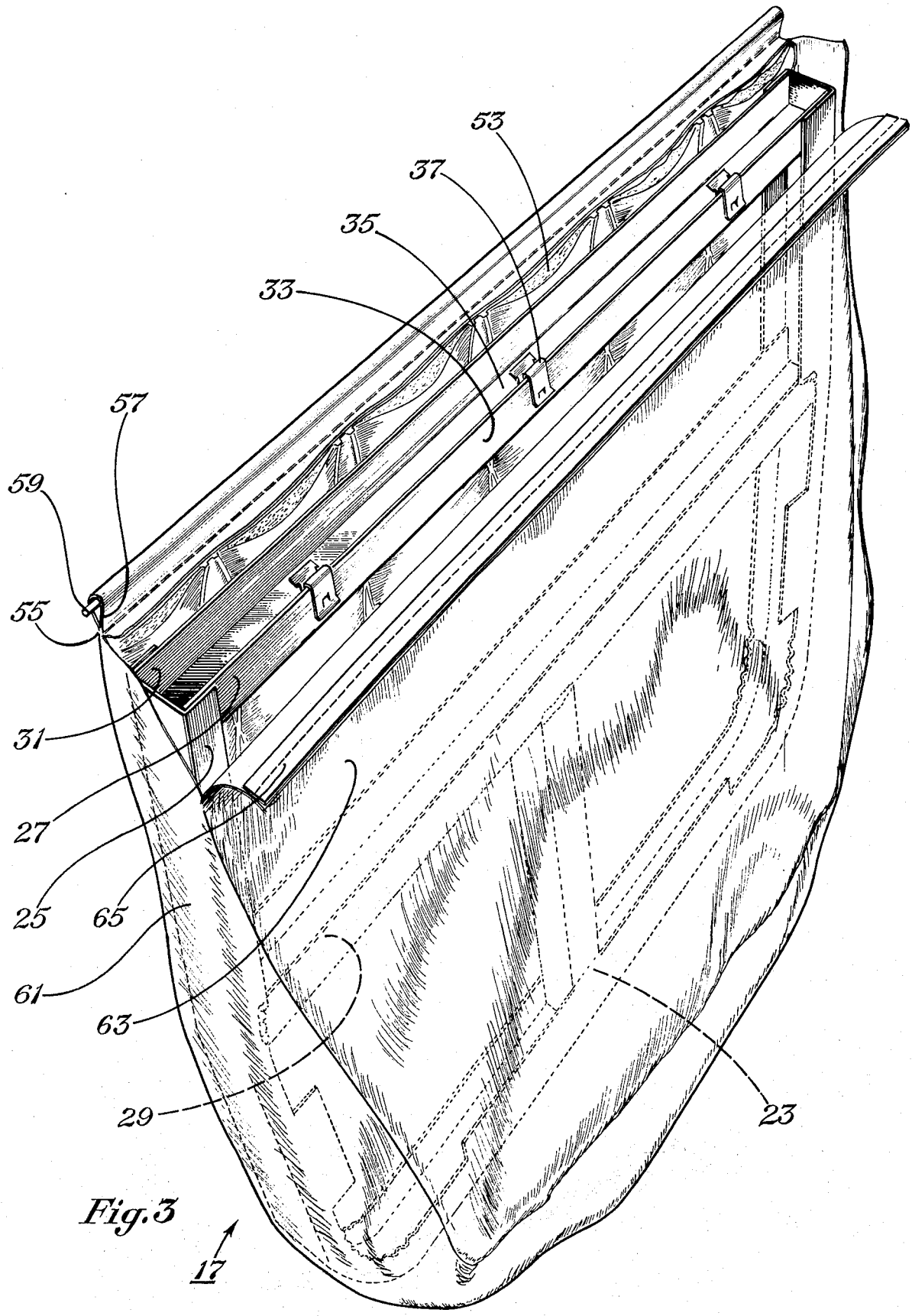
FIG. 3 is a perspective view of the back of one of the swivel chairs of FIG. 1, shown detached from its seat and with the padding removed.

Referring to FIG. 1, a vehicle or boat 11 is shown, having two swivel chairs 13 mounted on posts 15 to allow them to be swiveled. Referring also to FIG. 2, each chair has a back 17 and a seat 19. The back 17 is connected to the seat 19 by hinges 21 to allow the back 17 to be folded down until it rests on seat 19, as shown in the drawings. A strap (not shown) is frequently used to fasten the back 17 in the folded down position. In the upright position (not shown), the back 17 will be generally perpendicular to the seat 19.

As shown in FIG. 3, the back has a metal frame 23. Frame 23 includes a channel member 25 that is bent into a generally U-shaped configuration to form the sides and the top of the frame. A second channel member 27 is mounted between the ends of channel member 25. Other members 29 are secured between the portions of channel member 25 to add rigidity. Channel member 27 is rectangular, with a front wall 31 that will be on the front side of the chair back 17, and a rear wall 33 that is on the back side of the chair back 17. A bottom wall 35 connects the two walls 31 and 33. Walls 31 and 33 are parallel with each other and with the plane of the frame 23. Wall 35 is perpendicular to walls 31 and 33. The opening or slot of channel member 23 faces in the opposite direction from the top of frame 23. This direction will be considered to be the downward direction. Channel member 27 forms the base of the frame 23.

Several clips 37, normally about five, are carried by channel member 27. As shown in FIG. 4, each clip 37 is generally "S" shaped. It has two bights or U-shaped portions 39 and 41. Bight 39 is the same length as bight 41, but is smaller in width. Bight 39 has a protrusion or prong 43 protruding into the bight 39 and facing toward the curved part or base of bight 39. Bight 39 tightly fits over the back wall 33 of channel member 37. Bight 41 has a similar protrusion or prong 45 that protrudes into bight 41 and faces toward the base or bent portion of bight 41. Bight 39 and bight 41 both have lips 47 and 49, respectively, that are bent outward with respect to the legs of the bights to facilitate entry. The open end of bight 41 faces out of the channel, or downward, while bight 39 faces in the opposite direction.

Referring also to FIGS. 2 and 4, the upholstery material for the chair back 17 is normally vinyl and has a front portion 51 that is frequently sewn into pleats with foam or cushioning 53 within each pleat. A strip 55 of vinyl that is not pleated is sewn to the lower end of the front portion 51, forming the bottom or end of front portion 51. Strip 55 is doubled, forming a loop 57. A metal rod is inserted through loop 57.

One edge of a side portion 61 of vinyl is sewn around the sides and top of the front portion 51. A back piece or portion 63 is sewn to the other edge of the side portion 61. Normally the side portion 61 and back portion 63 are not pleated. A strip of cardboard 65 or of other material more rigid than vinyl is sewn to the lower end of the back portion 63 for stiffening. Once the front portion 51 and back portions 63 are secured together by the side portion 61, they define a bag-shaped enclosure with an open bottom.

To secure the upholstery over frame 23, the front portion 51 and back portion 63 are sewn together as described. Then foam padding 67 (FIG. 2), is placed around the frame 23. The padding 67 is not shown in FIG. 3 to provide more clarity. The enclosure defined by the front, back and side portions is drawn over the frame 23 and foam padding 67. The bights 39 of clips 37 are inserted over the back wall 33 of channel member 27. The end of back portion 63, with stiffener 65, is inserted into the bights 41. Then rod 59 is inserted into loop 57, and strip 55 is inserted into bight 41. The lengths of the front portion 51 and back portion 63 are selected so that the ends will have to be tightly pulled to accomplish insertion. The resiliency of bight 41 and prong 45 prevent the ends from being dislodged.

The side portion 61 remains open at its ends, but is covered by a hinge plate 69, which is secured by fasteners 71 to frame 23 after the back has been covered with the upholstery material.

It should be apparent that an invention having significant improvements has been provided. The closure means for the front and back portions provides an attractive junction with the clips being covered. The clips serve as efficient clip means for retaining the upholstery material in the channel. The method is quickly performed and the components inexpensive.

While the invention has been shown in only one of its forms, it should be apparent to those skilled in the art that it is not so limited but is susceptible to various changes and modifications without departing from the spirit thereof.

I claim:

1. In a vehicle chair of the type having a back connected to a seat, the back having a metal frame over which an enclosure of upholstery material with a front portion and a back portion is embraced, an improved closure means for securing the lower end of the front portion to the lower end of the back portion, comprising:

a frame member extending across the bottom of the frame, the member having front and back walls and a slot extending the length of the member between the walls;

the lower end of the front portion of the upholstery material and the lower end of the back portion of the upholstery material being drawn tightly together and inserted in the slot; and clip means mounted inside the slot of the frame member to one of the walls for retaining the ends of the material in contact with each other inside the slot.

2. The chair according to claim 1 wherein the frame member comprises a rectangular channel with an open side serving as the slot and facing downward.

3. The chair according to claim 2 wherein the clip means comprises a plurality of clips, each clip being resilient and having two U-shaped portions facing in opposite directions, one of the U-shaped portions being inserted tightly over one of the walls of the frame member, the ends of the front and back portion of the material being wedged into the other U-shaped portion.

4. The chair according to claim 3 wherein the end of one of the portions of the material has a stiffener strip secured to it, and the end of the other portion of material has a rod secured to it to facilitate insertion and retention in the clips.

5. In a vehicle chair of the type having a back connected to a seat, the back having a metal frame over which an enclosure of upholstery material with a front portion and a back portion is embraced, an improved closure means for securing the lower end of the front portion to the lower end of the back portion, comprising:

a rectangular channel member extending across the bottom of the frame, the channel member having a front wall and a rear wall parallel with each other and an opening along its length that faces downward;

a plurality of clips, each clip having two U-shaped portions facing in opposite directions, one of the U-shaped portions being tightly inserted over the back wall of the channel member, placing the other U-shaped portion in the channel member and facing downward;

the ends of the front portion and back portion of the upholstery material being tightly inserted in contact with each other into the downwardly facing U-shaped portion of the clips, the ends having stiffener means secured to them for stiffening the ends to facilitate insertion and retention in the clips.

6. The chair according to claim 5 wherein the front portion of the upholstery material has a strip of thinner material secured to its lower end, the strip containing a loop at its end, and wherein the stiffener means comprises a rod inserted through the loop and a stiffener strip of material more rigid than the upholstery material secured to the lower end of the back portion.

7. The chair according to claim 5 wherein each U-shaped portion of each clip has a prong protruding inward and toward the base of its U-shaped portion to increase retention.

* * * * *